US010613455B1

(12) United States Patent
Miyazaki et al.

(10) Patent No.: US 10,613,455 B1
(45) Date of Patent: Apr. 7, 2020

(54) AUTOMATIC CLEANING IMAGE FORMING APPARATUS AND METHOD OF CONTROLLING IMAGE FORMING APPARATUS

(71) Applicant: TOSHIBA TEC KABUSHIKI KAISHA, Shinagawa-ku, Tokyo (JP)

(72) Inventors: Yasunari Miyazaki, Shimizu Sunto Shizuoka (JP); Tomoyuki Kato, Kannami Tagata Shizukoa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/265,395

(22) Filed: Feb. 1, 2019

(51) Int. Cl.
*G03G 15/00* (2006.01)
*G03G 15/16* (2006.01)

(52) U.S. Cl.
CPC ..... *G03G 15/1665* (2013.01)

(58) Field of Classification Search
CPC ..... G03G 15/1665
USPC ..... 399/66
See application file for complete search history.

(56) References Cited

U.S. PATENT DOCUMENTS

2011/0268468 A1* 11/2011 Adachi ..... G03G 15/161 399/101

FOREIGN PATENT DOCUMENTS

JP 08248788 A * 9/1996
JP 2009098503 A * 5/2009
JP 2016-071318 A 5/2016

* cited by examiner

*Primary Examiner* — Quana Grainger
(74) *Attorney, Agent, or Firm* — Foley & Larnder LLP

(57) ABSTRACT

An image forming apparatus includes a photoconductive drum, a primary transfer belt, a secondary transfer counter roller, a secondary transfer roller, a bias control circuit, a belt cleaner, and a processor. The photoconductive drum forms a toner image. The primary transfer belt comes in contact with the photoconductive drum and receives the toner image from the photoconductive drum. The secondary transfer counter roller moves the primary transfer belt. The secondary transfer roller presses a printing medium against the primary transfer belt to transfer the toner image on the primary transfer belt to the printing medium. The bias control circuit applies a bias to the secondary transfer roller. The belt cleaner is in contact with the primary transfer belt and removes attached matters from the primary transfer belt. When a printing operation is interrupted, a cleaning operation can be executed to remove residuals on the primary transfer belt.

18 Claims, 4 Drawing Sheets

AUTOMATIC CLEANING IMAGE FORMING APPARATUS AND METHOD OF CONTROLLING IMAGE FORMING APPARATUS

FIELD

Embodiments described herein relate generally to an image forming apparatus and a method of controlling the image forming apparatus.

BACKGROUND

An image forming apparatus includes a photoconductor, a primary transfer belt, a primary transfer roller, and a secondary transfer roller. The image forming apparatus forms a toner image in the photoconductor, and transfers the toner image formed in the photoconductor to the primary transfer belt by the primary transfer roller. The image forming apparatus moves the primary transfer belt, and transports the toner image to a transfer nip formed between the primary transfer belt and the secondary transfer roller. In addition, the image forming apparatus transports a printing medium to the transfer nip. When the printing medium passes through the transfer nip, the image forming apparatus applies, to the secondary transfer roller, an electrical bias (a secondary transfer bias) for attracting the electrically charged toner on the primary transfer belt toward the secondary transfer roller. Accordingly, the image forming apparatus transfers the toner on the primary transfer belt to the printing medium.

In addition, in the image forming apparatus, after the toner image is formed, the printing operation may be interrupted. When the printing operation is interrupted, the image forming apparatus needs to remove the toner on the primary transfer belt in order to perform a next printing operation. Therefore, the image forming apparatus includes a belt cleaner that removes the toner from the primary transfer belt. The belt cleaner has a blade that is in contact with the primary transfer belt. The image forming apparatus moves the primary transfer belt, and transports the toner to a belt cleaning position where the primary transfer belt and the blade of the belt cleaner are in contact with each other. Accordingly, when passing through the belt cleaning position, the toner or other matters attached on the primary transfer belt are removed to a blade side from the primary transfer belt.

Further, when the image forming apparatus interrupts the printing operation, and transports the toner on the primary transfer belt to the belt cleaning position, when the toner on the primary transfer belt passes through the transfer nip, a bias (a cleaning bias) opposite to the forward bias is applied to the secondary transfer roller. Accordingly, the image forming apparatus prevents the toner from being attached to the secondary transfer roller from the primary transfer belt.

As described above, when the reverse bias is applied to the secondary transfer roller, paper dust accumulated near the secondary transfer roller is swept out toward the primary transfer belt by the reverse bias of the secondary transfer roller. The paper dust swept out to the primary transfer belt is removed by the belt cleaner. However, the paper dust has various sizes, and there is a possibility that not all paper dust is caught by the belt cleaner depending on the sizes of the paper dust. There is a problem when the toner and the paper dust are caught by the belt cleaner, but the toner and the paper dust may not be properly removed and remain in the primary transfer belt. This may cause image defects.

DETAILED DESCRIPTION

An image forming apparatus according to an embodiment includes a photoconductive drum, a primary transfer belt, a secondary transfer counter roller, a secondary transfer roller, a bias control circuit, a belt cleaner, and a processor. The photoconductive drum forms a toner image. The primary transfer belt comes in contact with the photoconductive drum and receives the toner image from the photoconductive drum. The secondary transfer counter roller moves the primary transfer belt. The secondary transfer roller presses a printing medium against the primary transfer belt to transfer the toner image on the primary transfer belt to the printing medium. The bias control circuit applies a bias to the secondary transfer roller. The belt cleaner is in contact with the primary transfer belt and removes attached matters from the primary transfer belt. The processor performs a printing operation of transferring the toner image to the printing medium, and determines whether or not the printing operation is interrupted. When it is determined that the printing operation is interrupted, the processor controls to, so as to perform a forward rotation operation while applying, to the secondary transfer roller, a bias having a polarity that is opposite to that in the printing operation, by the bias control circuit, perform a reverse rotation operation that is opposite to the forward rotation operation, restart the forward rotation operation, and restart the printing operation, by the photoconductive drum, the secondary transfer counter roller, and the secondary transfer roller.

Hereinafter, the image forming apparatus and a method of controlling the image forming apparatus according to the embodiment will be described with reference to the drawings.

Figure 1:
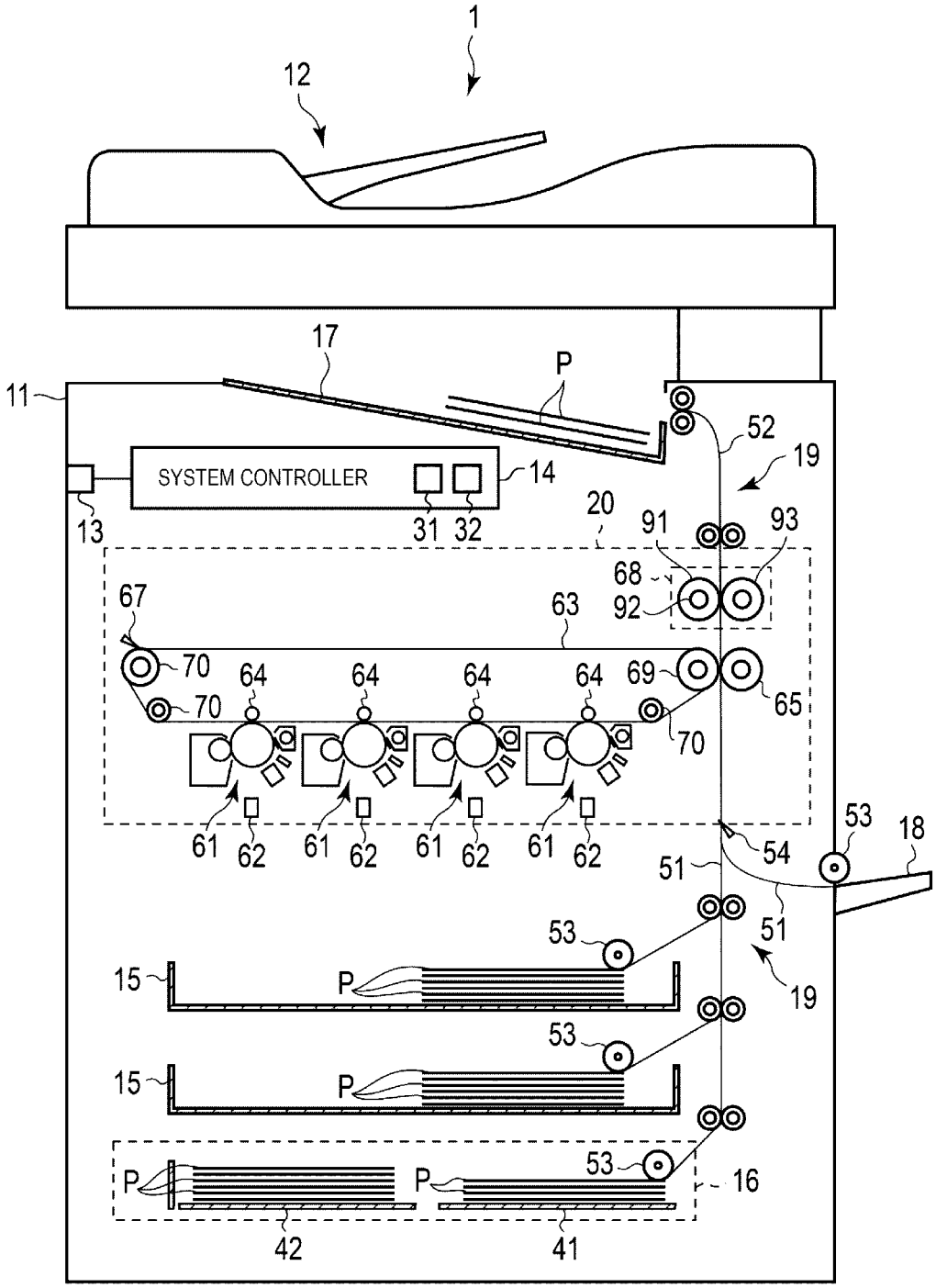
FIG. 1 is a view for illustrating a configuration example of an image forming apparatus according to an embodiment.

FIG. 1 is a view for illustrating a configuration example of an image forming apparatus 1 according to the embodiment.

The image forming apparatus 1 is, for example, a multifunction printer (MFP) that performs various processes such as formation of an image while transporting a recording medium such as the printing medium. The image forming apparatus 1 is, for example, a solid scanning type printer (for example, LED printer) that scans an LED array that performs various processes such as the formation of an image while transporting the recording medium such as the printing medium. The image forming apparatus 1 may be configured to form an image on the printing medium with a single color toner or may be configured to form an image on the printing medium with toners having a plurality of colors. In addition, the image forming apparatus 1 may be configured to form an image on the printing medium with a toner (decolorable toner) which is decolorized by external stimulation. The external stimulation is, for example, a temperature, a light beam having a specific wavelength, a pressure, or the like which is provided to the toner. The decolorizing indicates that an image formed with a color that is different from a color of the printing medium as the background becomes visually invisible (for example, becomes colorless).

As illustrated in FIG. 1, the image forming apparatus 1 includes a housing 11, an image reading unit 12, a communication interface 13, a system controller 14, a plurality of paper feeding cassettes 15, a tandem large cassette feeding (LCF) unit 16, a paper discharging tray 17, a manual feeding tray 18, a transport unit 19, and an image forming unit 20.

The housing 11 is a main body of the image forming apparatus 1. The housing 11 accommodates the image reading unit 12, the communication interface 13, the system controller 14, the plurality of paper feeding cassettes 15, the tandem LCF unit 16, the transport unit 19, and the image forming unit 20.

The image reading unit 12 is configured to read an image from an original document. The image reading unit 12 includes, for example, a scanner. The scanner acquires the image of the original document under a control of the system controller 14.

The communication interface 13 is an interface configured to communicate with another device. The communication interface 13 is used to, for example, communicate with a host device (external device). The communication interface 13 is configured as, for example, a LAN connector. In addition, the communication interface 13 may wirelessly communicate with another device according to a standard such as Bluetooth (registered trademark) and Wi-Fi (registered trademark).

The system controller 14 controls the image forming apparatus 1. The system controller 14 includes, for example, a processor 31 and a memory 32. In addition, the system controller 14 is connected to the image reading unit 12, the image forming unit 20, the transport unit 19, and the like via a bus and the like.

The processor 31 is an arithmetic element configured to perform arithmetic processing. The processor 31 is, for example, a CPU. The processor 31 performs various processes based on data of a program or the like stored in the memory 32. The processor 31 functions as a control unit that can perform various operations by executing the program stored in the memory 32.

The memory 32 is a storage medium that stores the program and the data used in the program. In addition, the memory 32 also functions as a working memory. That is, the memory 32 temporarily stores the data that is being processed by the processor 31, the program executed by the processor 31, and the like.

The processor 31 controls the image reading unit 12, the image forming unit 20, and the transport unit 19 by executing the program stored in the memory 32.

The plurality of paper feeding cassettes 15 are cassettes that accommodate printing mediums P. The paper feeding cassettes 15 may supply the printing mediums P from the outside of the housing 11. For example, the paper feeding cassettes 15 may be withdrawn from the housing 11.

The tandem. LCF unit 16 is a unit that accommodates a large amount of the printing mediums P. The tandem LCF unit 16 includes a plurality of first cassettes 41 and a plurality of second cassettes 42 that accommodate the printing mediums P. The first cassettes 41 and the second cassettes 42 are configured to be able to supply the printing mediums P from the outside of the housing 11. The tandem LCF unit 16 performs a process of transferring the printing mediums P accommodated in the second cassettes 42 to the first cassettes 41 based on the control of the system controller 14.

The paper discharging tray 17 is a tray that supports the printing mediums P discharged from the image forming apparatus 1.

The manual feeding tray 18 is a tray that supports the printing mediums P introduced into the image forming apparatus 1.

The transport unit 19 is configured to transport the printing mediums P into the image forming apparatus 1. As illustrated in FIG. 1, the transport unit 19 includes a paper feeding transport path 51 and a paper discharging transport path 52.

The paper feeding transport path 51 and the paper discharging transport path 52 are configured with a plurality of guides, a plurality of rollers, and a plurality of motors, which are not illustrated. As the motors operated based on the control of the system controller 14 rotate the rollers that rotate the printing mediums P in an inserted state to move the printing mediums P, the paper feeding transport path 51 and the paper discharging transport path 52 transport the printing mediums P.

The paper feeding transport path 51 introduces the printing mediums P from the paper feeding cassettes 15 or the tandem LCF unit 16 and supplies the introduced printing mediums P to the image forming unit 20. The paper feeding transport path 51 includes a plurality of pickup rollers 53. The pickup rollers 53 are provided in the paper feeding cassettes 15, respectively. The pickup rollers 53 introduce the printing mediums P of the paper feeding cassettes 15 into the paper feeding transport path 51. Further, the pickup rollers 53 are provided in the first cassettes 41 of the tandem LCF unit 16. The pickup rollers 53 introduce the printing mediums P of the first cassettes 41 of the tandem LCF unit 16 into the paper feeding transport path 51. Further, the pickup rollers 53 are provided also at positions where the pickup rollers 53 can introduce the printing mediums P disposed in the manual feeding tray 18. The pickup rollers 53 introduce the printing mediums P disposed in the manual feeding tray 18 into the paper feeding transport path 51.

Further, a passage sensor 54 is provided in the paper feeding transport path 51. The passage sensor 54 detects passage of the printing mediums P. The passage sensor 54 is provided at a position where the passage sensor 54 detects whether or not the printing mediums P enter the image forming unit 20. The passage sensor 54 notifies a result of the detection to the system controller 14.

The paper discharging transport path 52 is a transport path that discharges, from the housing 11, the printing mediums P on which images are formed by the image forming unit 20. The printing mediums P discharged by the paper discharging transport path 52 are discharged to the paper discharging tray 17.

Next, the image forming unit 20 will be described.

The image forming unit 20 is configured to form images on the printing mediums P, based on the control of the system controller 14. In detail, the image forming unit 20 forms the images on the printing mediums P, based on a printing job generated by the processor 31. As illustrated in FIG. 1, the image forming unit 20 includes a plurality of process units 61, a plurality of exposure devices 62, a primary transfer belt 63, a plurality of primary transfer rollers 64, a secondary transfer roller 65, a bias control circuit 66, a belt cleaner 67, a fixing device 68, and a secondary transfer counter roller 69.

First, a configuration related to image formation of the image forming unit 20 will be described.

The process units 61 are configured to form a toner image. For example, the image forming unit 20 includes the process units 61 for different colors such as cyan, magenta, yellow, and black. Further, since the plurality of process units 61 have the same configuration except for filled developing agents, one process unit 61 will be described.

Figure 2:
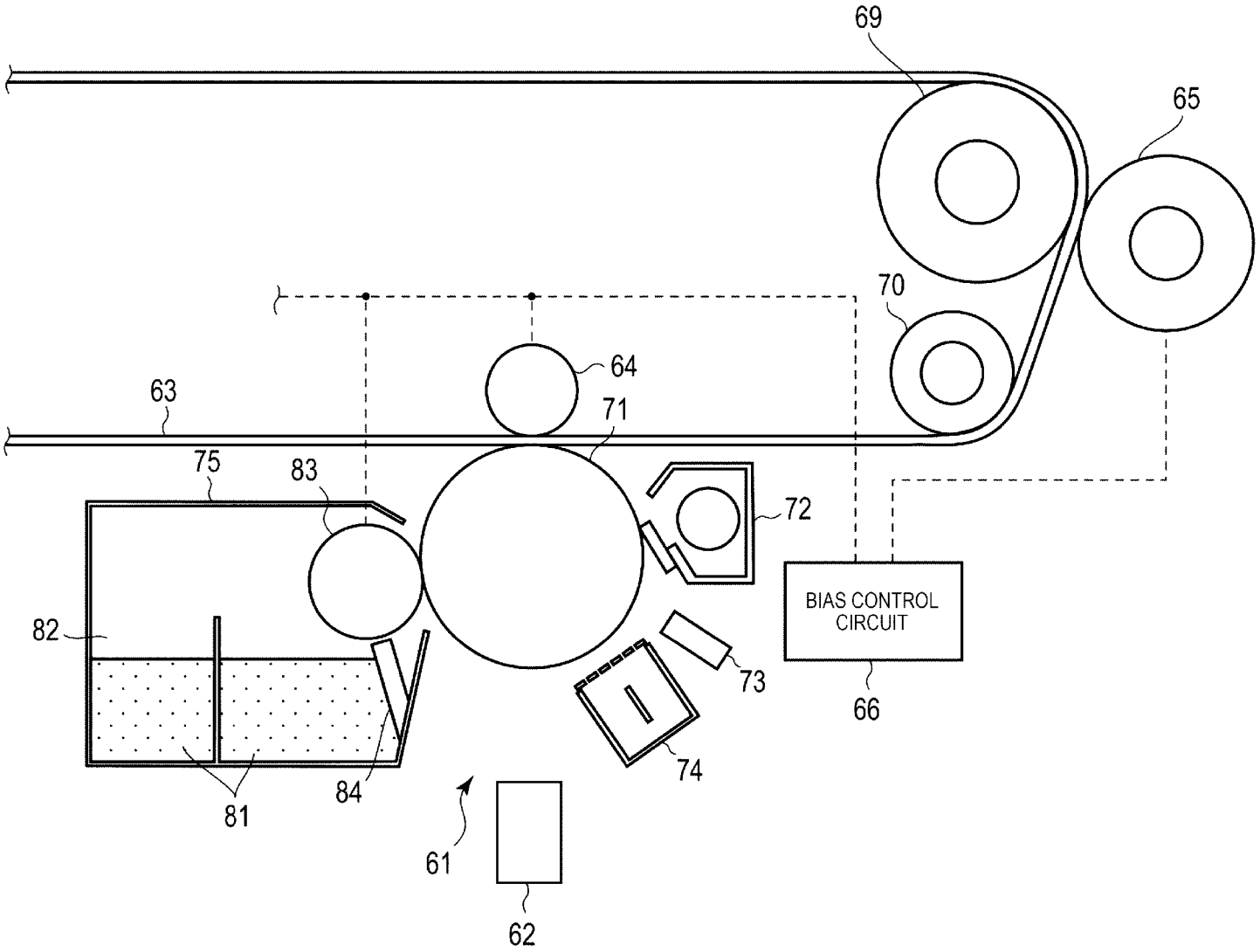
FIG. 2 is a view for illustrating a configuration example of a part of an image forming unit according to the embodiment.

FIG. 2 is a view for illustrating an example of a configuration of the process unit 61. As illustrated in FIG. 2, the process unit 61 includes a photoconductive drum 71, a photoconductor cleaner 72, a static eliminator 73, an electrifying charger 74, and a developing device 75.

The photoconductive drum 71 is a photoconductor including a cylindrical drum and a photoconductive layer formed on the outer peripheral surface of the drum. The drum is, for example, an aluminum cylinder. The photoconductive layer is, for example, an organic photoconductor (OPC) coated on the surface of the aluminum cylinder. The photoconductive drum 71 is rotated at a constant speed by a not illustrated driving mechanism.

The photoconductor cleaner 72 removes the toner attached to the photoconductive drum 71 by a blade that is in contact with the photoconductive drum 71. The blade of the photoconductor cleaner 72 is formed of an elastic material such as urethane resin to have a plate shape. Further, a position where the photoconductive drum 71 and the blade of the photoconductor cleaner 72 are in contact with each other is referred to as a photoconductor cleaning position.

The static eliminator 73 removes static electricity remaining on the photoconductive drum 71. The static eliminator 73, for example, irradiates the photoconductive drum 71 with light, to release the static electricity by an electrically conductive property of the photoconductive layer of the photoconductive drum 71.

The electrifying charger 74 evenly electrifies the surface of the photoconductive drum 71. For example, the electrifying charger 74 charges the photoconductive drum 71 to a uniform negative potential using a charging roller. The charging roller is rotated by rotation of the photoconductive drum 71 while applying a predetermined pressure to the photoconductive drum 71.

The developing device 75 is a device that attaches the toner to the photoconductive drum 71. The developing device 75 includes a developing agent container 82 filled with a developing agent 81, a developing sleeve 83, and a doctor blade 84.

The developing agent container 82 is a container that accommodates the developing agent 81 containing the toner and a carrier. The developing agent 81 is filled in a not illustrated cartridge. Further, a not illustrated stirring mechanism is provided inside the developing agent container 82. The stirring mechanism maintains a state of the developing agent 81 by stirring the developing agent 81.

The developing sleeve 83 rotates inside the developing agent container 82 to attach the toner to the photoconductive drum 71. Further, a bias is applied to the developing sleeve 83 by the bias control circuit 66.

The doctor blade 84 is a member that is disposed to be spaced apart from the developing sleeve 83 by a predetermined distance. The doctor blade 84 adjusts the thickness of a layer of the developing agent 81 formed on the developing sleeve 83.

The plurality of exposure devices 62 are provided to correspond to the photoconductive drums 71 of the process units 61, respectively. Each of the exposure devices 62 includes a light emitting element such as a laser diode and a light emitting diode (LED). The exposure device 62 irradiates the charged photoconductive drum 71 with a laser light beam by the light emitting element, to form an electrostatic latent image on the photoconductive drum 71.

Next, a configuration related to transfer of the image forming unit 20 will be described.

The primary transfer belt 63 is an endless belt wound on the secondary transfer counter roller 69 and a plurality of winding rollers 70. The inner surface (inner peripheral surface) of the primary transfer belt 63 is in contact with the secondary transfer counter roller 69 and the plurality of winding rollers 70, and the outer surface (outer peripheral surface) of the primary transfer belt 63 faces the photoconductive drum 71 of the process unit 61.

The secondary transfer counter roller 69 is rotated by a not illustrated motor. The plurality of winding rollers 70 are configured to be freely rotatable. The primary transfer belt 63 moves by rotation of the secondary transfer counter roller 69 and the plurality of winding rollers 70. The plurality of winding rollers 70 rotate as the primary transfer belt 63 moves by the secondary transfer counter roller 69.

The plurality of primary transfer rollers 64 are configured to allow the primary transfer belt 63 to come into contact with the photoconductive drums 71 of the process units 61. The plurality of primary transfer rollers 64 are provided to correspond to the plurality of process units 61. In detail, the plurality of primary transfer rollers 64 are provided at positions corresponding to the photoconductive drums 71 of the process units 61, respectively, with the primary transfer belt 63 interposed therebetween. The primary transfer rollers 64 are in contact with the inner peripheral side of the primary transfer belt 63 and displace the primary transfer belt 63 toward the photoconductive drums 71. Accordingly, the primary transfer rollers 64 allow the outer peripheral surface of the primary transfer belt 63 to come into contact with the photoconductive drums 71. Further, positions where the outer peripheral surface of the primary transfer belt 63 and the photoconductive drums 71 come in contact with each other are referred to as a primary transfer position. Further, the bias is applied to the primary transfer rollers 64 by the bias control circuit 66.

The secondary transfer roller 65 is provided to a position facing the primary transfer belt 63. The secondary transfer roller 65 is in contact with the outer peripheral surface of the primary transfer belt 63, and applies a pressure. Accordingly, a transfer nip is formed in which the secondary transfer roller 65 and the outer peripheral surface of the primary transfer belt 63 are in close contact with each other. When the printing mediums P pass through the transfer nip, the secondary transfer roller 65 presses the printing mediums P passing through the transfer nip against the outer peripheral surface of the primary transfer belt 63. Further, the bias is applied to the secondary transfer roller 65 by the bias control circuit 66.

The bias control circuit 66 controls the bias applied to the primary transfer rollers 64, the secondary transfer roller 65, and the developing sleeve 83 based on the control of the system controller.

The belt cleaner 67 removes attached matters attached to the outer peripheral surface of the primary transfer belt 63. The attached matters are the toner, paper dust, or the like remaining on the primary transfer belt 63 after passing through the transfer nip. The belt cleaner 67 includes a blade that is in contact with the outer peripheral surface of the primary transfer belt 63 on a downstream side of the transfer nip. For example, the blade of the belt cleaner 67 is formed of an elastic material such as urethane resin to have a plate shape. Further, a position where the outer peripheral surface of the primary transfer belt 63 and the blade of the belt cleaner 67 are in contact with each other is referred to as a belt cleaning position. The belt cleaner 67 includes a waste toner box and a rotation auger. The rotation auger transfers the attached matters transferred to the blade, to the waste toner box.

Next, a configuration related to fixing of the image forming unit 20 will be described.

The fixing device 68 fixes the toner image to the printing mediums P on which the toner image is formed. The fixing device 68 operates based on the control of the system controller 14. The fixing device 68 includes a heating member for applying heat to the printing mediums P and a pressing member for applying pressure to the printing mediums P. For example, the fixing device 68 includes a heat roller 91 and a heater 92 as the heating member. For example, the fixing device 68 includes a press roller 93 as the pressing member.

The heat roller 91 is a fixing rotator heated to a high temperature by the heater 92. The heat roller 91 is rotated by a not illustrated motor. The heat roller 91 includes a hollow core metal formed of metal and an elastic layer formed on the outer periphery of the core metal.

The heater 92 heats the heat roller 91. For example, the heater 92 is disposed inside the hollow core metal formed in the heat roller 91. The heater 92 heats the heat roller 91 to a high temperature by heating the core metal of the heat roller 91 from the inside. The heater 92 is, for example, a halogen heater. Further, the heater 92 may be an induction heating (IH) heater that heats the core metal through electromagnetic induction.

The press roller 93 is provided at a position that is opposite to the heat roller 91. The press roller 93 includes a core metal formed of metal having a predetermined outer diameter and an elastic layer formed on the outer periphery of the core metal.

The press roller 93 applies pressure to the heat roller 91 by a stress applied from a not illustrated tension member. A nip (fixing nip) in which the press roller 93 and the heat roller 91 are in close contact with each other is formed as pressure is applied from the press roller 93 to the heat roller 91. The press roller 93 is rotated by a not illustrated motor. The press roller 93 moves the printing mediums P entering the fixing nip through rotation, and presses the printing mediums P against the heat roller 91.

Next, an operation of the image forming apparatus 1 will be described.

Figure 3:
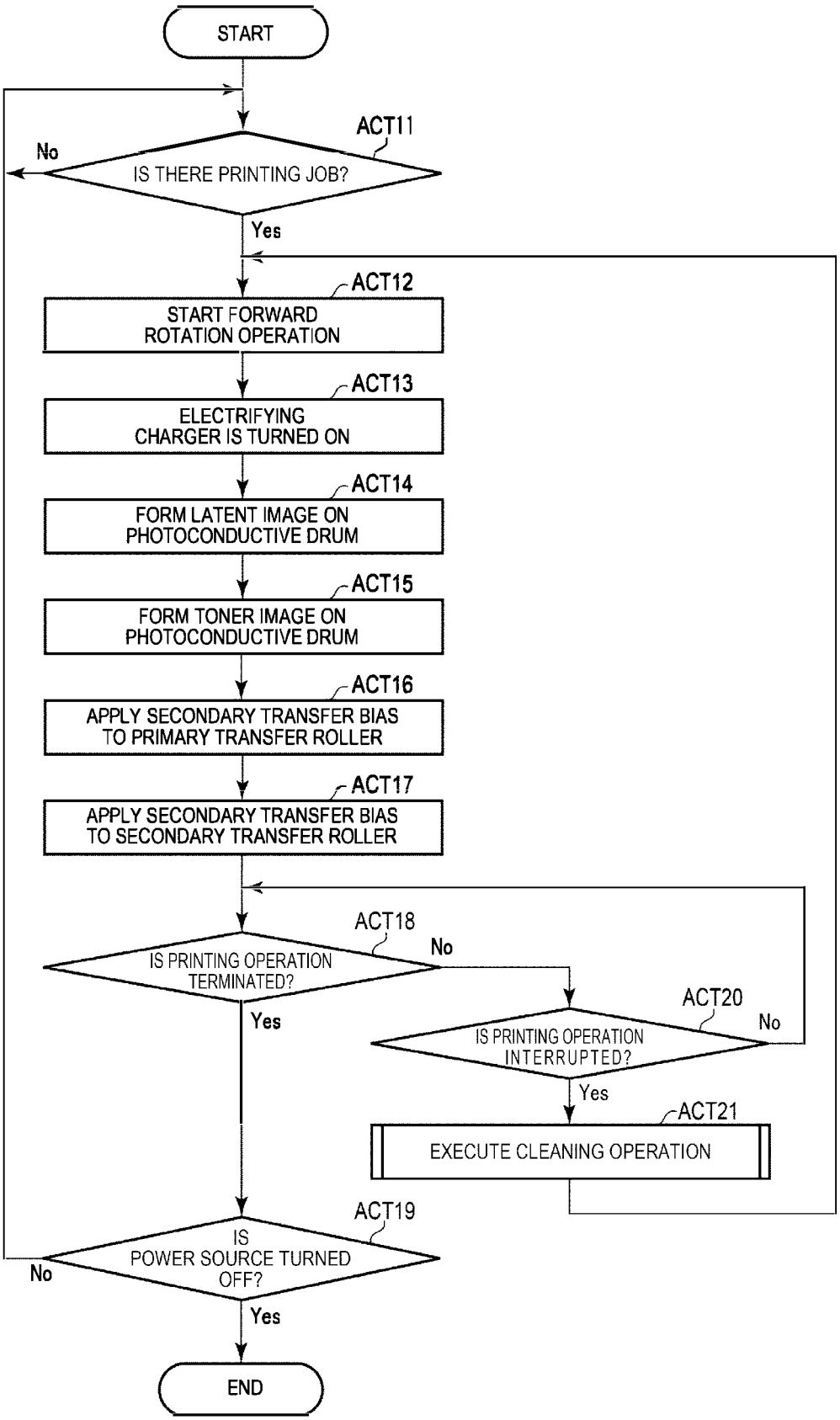
FIG. 3 is a view for illustrating an example of control of the image forming apparatus when a printing operation is performed according to the embodiment.

First, a printing operation will be described. FIG. 3 is a flowchart for illustrating the printing operation of the image forming apparatus 1. In the above configuration, the processor 31 of the system controller 14 performs a process of generating the printing job for forming an image on the printing medium P by executing the program stored in the memory 32. For example, the processor 31 generates the printing job based on an image acquired by an external device through the communication interface 13 and an image acquired by the image reading unit 12. The processor 31 stores the generated printing job in the memory 32.

The printing job includes image data illustrating the image formed in the printing medium P. The image data may be data for forming an image on one printing medium P or may be data for forming images on a plurality of printing mediums P.

When the image forming apparatus 1 is turned on, the processor 31 controls the heater 92 to heat the heat roller 91 of the fixing device 68 of the image forming unit 20 by electric power of a not illustrated power supply circuit. When the temperature of the heat roller 91 reaches a temperature required for fixing the toner, the image forming apparatus 1 becomes a printable state (ready state). Accordingly, execution of the printing job is enabled.

The processor 31 determines whether or not there is the printing job (Act 11). When it is determined that there is the printing job (Act 11, Yes), the processor 31 controls the image forming apparatus 1 to perform the printing operation based on the printing job. When the image forming apparatus 1 is in a ready state, the processor 31 controls the image forming unit 20 and the transport unit 19 based on the printing job stored in the memory 32. Accordingly, the processor 31 causes the image forming apparatus 1 to execute the printing operation of forming an image corresponding to the image data of the printing job on the printing medium P.

Further, the processor 31 controls the image forming unit to start a forward rotation operation of rotating the photoconductive drum 71, the secondary transfer roller 65, and the secondary transfer counter roller 69 at a predetermined speed (Act 12). As the secondary transfer counter roller 69 rotates, the primary transfer belt 63 also rotates. The forward rotation operation is an operation of rotating the photoconductive drum 71, the secondary transfer roller 65, and the secondary transfer counter roller 69 such that the printing medium P passes through the transfer nip from the paper feeding transport path 51 toward the fixing device 68. Further, the processor 31 controls the transport unit 19 to introduce the printing medium P into the paper feeding transport path 51, and supply the printing medium P to the image forming unit 20.

Further, the processor 31 turns on the electrifying charger 74 to charge the surface of the photoconductive drum 71 (Act 13). As described above, the entire surface of the photoconductive drum 71 is uniformly charged such that the photoconductive drum 71 rotates at a constant speed.

The processor 31 forms the electrostatic latent image on the photoconductive drum 71 by the exposure device 62 (Act 14). The processor 31 controls an operation of the exposure device 62 based on the image data of the printing job. Accordingly, the exposure device 62 irradiates the surface of the photoconductive drum 71 with a light beam corresponding to the image data. The potential of the position where the light is emitted from the exposure device 62 of the photoconductive drum 71 is reduced. As a result, the electrostatic latent image corresponding to the image data of the printing job is formed on the surface of the photoconductive drum 71.

The processor 31 forms the toner image on the photoconductive drum 71 by the developing device 75 (Act 15). The processor 31 applies a bias to the developing sleeve 83 of the developing device 75 by the bias control circuit 66, and rotates the developing sleeve 83 of the developing device 75. Accordingly, the developing agent 81 is attached to the surface of the developing sleeve 83 of the developing device 75. Further, as the doctor blade 84 adjusts the thickness of the developing agent 81 on the surface of the developing sleeve 83, a layer of the developing agent 81 having a constant thickness is formed on the surface of the developing sleeve 83. Further, when the developing agent layer formed on the surface of the developing sleeve 83 comes into contact with the surface of the photoconductive drum 71, the toner contained in the developing agent 81 is attached to the latent image formed on the surface of the photoconductive drum 71. Accordingly, the toner image is formed on the surface of the photoconductive drum 71.

The processor 31 applies a primary transfer bias to the primary transfer rollers 64 by the bias control circuit 66 (Act 16). The processor 31 applies, by the bias control circuit 66, to the primary transfer rollers 64, the bias (primary transfer bias) for generating an electric field through which the toner image on the photoconductive drum 71 is transferred to the outer peripheral surface of the primary transfer belt 63.

Further, the processor 31 applies a secondary transfer bias to the secondary transfer roller 65 by the bias control circuit 66 (Act 17). The processor 31 applies, by the bias control circuit 66, to the secondary transfer roller 65, the bias (secondary transfer bias) for generating an electric field through which the toner image on the outer peripheral surface of the primary transfer belt 63 is transferred to the printing medium P.

As described above, the primary transfer bias is applied to the primary transfer rollers 64, the secondary transfer bias is applied to the secondary transfer rollers 65, and the photoconductive drum 71, the secondary transfer roller 65, and the secondary transfer counter roller 69 perform the forward rotation operation. As a result, the toner image formed on the surface of the photoconductive drum 71 is transferred onto the outer peripheral surface of the primary transfer belt 63 by the primary transfer bias applied to the primary transfer rollers 64 at the primary transfer position.

Further, the toner image transferred to the outer peripheral surface of the primary transfer belt 63 is moved, by the primary transfer belt 63, to the transfer nip in which the secondary transfer roller 65 and the outer peripheral surface of the primary transfer belt 63 are in close contact with each other. The toner image transferred to the outer peripheral surface of the primary transfer belt 63 is transferred toward the secondary transfer roller 65 by the secondary transfer bias applied to the secondary transfer roller 65 in the transfer nip. When the printing medium P exists in the transfer nip, the toner image is transferred to the printing medium P. That is, the toner image on the outer peripheral surface of the primary transfer belt 63 is transferred to the printing medium P passing through the transfer nip.

The printing medium P which passes through the transfer nip and onto which the toner image is transferred is introduced into the fixing nip in which the heat roller 91 and the press roller 93 of the fixing device 68 are in close contact with each other. The processor 31 controls the fixing device 68 to apply heat and pressure to the printing medium P passing through the fixing nip. Accordingly, the processor 31 fixes the toner image to the printing medium P by the fixing device 68. As a result, the image is formed on the printing medium P.

The processor 31 determines whether or not the image is completely formed on the printing medium P by the above processing (Act 18). When it is determined that the image is completely formed on the printing medium P (Act 18, Yes), the processor 31 determines whether or not a power source of the image forming apparatus 1 is turned off (Act 19). When it is determined that the power source of the image forming apparatus 1 is turned off (Act 19, Yes), the processor 31 stops the supply of electric power from a power supply circuit, and terminates the process of FIG. 3. Further, when it is determined that the power source of the image forming apparatus 1 is not turned off (Act 19, No), the processor 31 proceeds to the processing of Act 11. Accordingly, the processor 31 proceeds to processing of a next printing job.

Further, when it is determined that the image is not completely formed on the printing medium P (Act 18, No), the processor 31 determines whether or not the printing operation is interrupted (Act 20). When it is determined that the printing operation is not interrupted (Act 20, No), the processor 31 proceeds to the processing of Act 18. Further, when it is determined that the printing operation is interrupted (Act 20, Yes), the processor 31 executes a cleaning operation, which will be described below (Act 21), and proceeds to the processing of Act 12.

As described above, the processor 31 sequentially determines whether or not the printing operation is interrupted, while executing the printing operation. In some embodiments, the processor 31 determines the toner image fails to transfer when a paper jam occurred before finishing the transferring process (e.g., the processor 31 receives a jamming signal). For example, when it is determined that the toner image cannot be transferred to the printing medium P in the transfer nip after the toner image is transferred to the primary transfer belt 63, the processor 31 interrupts the printing operation and causes the image forming apparatus 1 to execute the cleaning operation. Further, for example, when it is determined that the toner image cannot be transferred to the printing medium P in the transfer nip at a timing after the electrostatic latent image is formed on the photoconductive drum 71, the processor 31 may be configured to interrupt the printing operation, and cause the image forming apparatus 1 to execute the cleaning operation.

For example, when a paper feeding retrying operation is generated, an automatic cassette changing operation is generated, or a tandem LCF transfer operation is generated, the processor interrupts the printing operation in response to these generated operations.

During the printing operation, even when the processor 31 controls the transport unit 19 to supply the printing medium P to the transfer nip, when the passage sensor 54 does not detect passage of the printing medium P, the processor 31 performs the paper feeding retrying operation. The paper feeding retrying operation is a process of controlling the transport unit 19 to introduce the printing medium P from the paper feeding cassettes 15 to the paper feeding transport path 51 again. For example, the processor 31 interrupts the printing operation, causes the image forming apparatus to execute the cleaning operation, executes the paper feeding retrying operation, and restarts the printing operation.

Further, during the printing operation, when the printing mediums P of the paper feeding cassettes 15 are emptied, the processor 31 performs the automatic cassette changing operation. The automatic cassette changing operation is a process of switching the paper feeding cassettes 15, and introducing the printing mediums P from the switched paper feeding cassettes 15 into the paper feeding transport path 51. For example, the processor 31 interrupts the printing operation, causes the image forming apparatus 1 to execute the cleaning operation, executes the automatic cassette changing operation, and restarts the printing operation.

Further, during the printing operation, when the printing mediums P of the first cassettes 41 are emptied, the processor 31 performs the tandem LCF transfer operation. The tandem LCF transfer operation is a process of transferring the printing mediums P accommodated in the second cassettes 42 to the first cassettes 41. For example, the processor 31 interrupts the printing operation, causes the image forming apparatus to execute the cleaning operation, executes the tandem LCF transfer operation, and restarts the printing operation.

Figure 4:
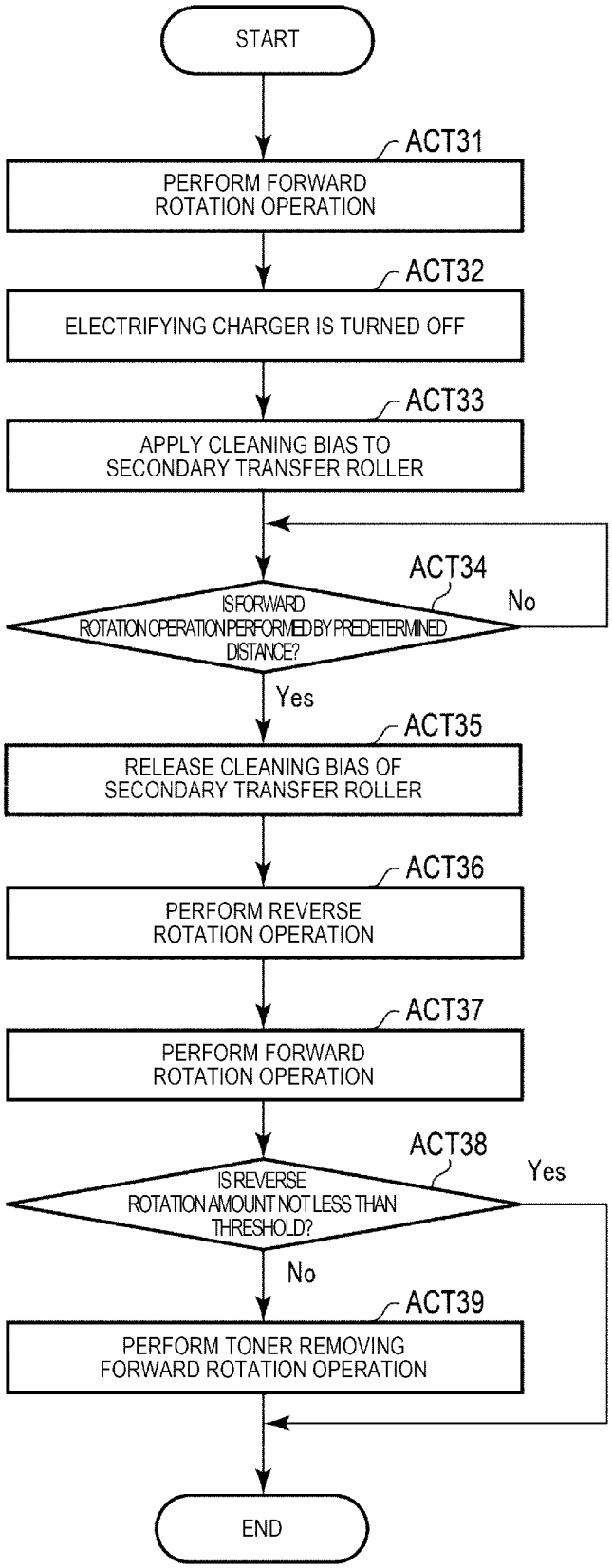
FIG. 4 is a view for illustrating an example of control of the image forming apparatus when a cleaning operation is performed according to the embodiment.

Next, the cleaning operation will be described. FIG. 4 is a view for illustrating the cleaning operation. In the above-described configuration, the processor 31 of the system controller 14 causes the image forming apparatus 1 to execute the cleaning operation of removing the toner image transferred to the primary transfer belt 63, by executing the program stored in the memory 32.

As described above, in the image forming apparatus 1, when the printing operation is interrupted once, in order to perform the next printing operation, it is necessary to remove the toner on the primary transfer belt 63. Thus, the processor 31 controls the photoconductive drum 71, the secondary transfer roller 65, the secondary transfer counter roller 69, and the bias control circuit 66 such that the toner image formed on the primary transfer belt 63 is removed by the belt cleaner 67.

First, the processor 31 performs the forward rotation operation of rotating the photoconductive drum 71, the secondary transfer roller 65, and the secondary transfer counter roller 69 at a predetermined speed (Act 31). Further, when it is determined in Act 20 of FIG. 3 that the printing operation is interrupted, the photoconductive drum 71, the secondary transfer roller 65, and the secondary transfer counter roller 69 already perform the forward rotation operation. Thus, the processor 31 continues the forward rotation operation of the photoconductive drum 71, the secondary transfer roller 65, and the secondary transfer counter roller 69.

Next, the processor 31 turns off the electrifying charger 74 (Act 32). Accordingly, the processor 31 performs a control such that the photoconductive drum 71 is not charged. Further, the processor 31 controls the bias control circuit 66 to release the application of the bias of the developing sleeve 83. Accordingly, the toner is not attached to the photoconductive drum 71 from the developing device 75. Furthermore, the processor 31 releases the application of the primary transfer bias to the primary transfer rollers 64 by the bias control circuit 66.

Next, the processor 31 controls the bias control circuit 66 to apply a cleaning bias to the secondary transfer roller 65 by the bias control circuit 66 (Act 33). The cleaning bias is a bias for preventing the toner image on the outer peripheral surface of the primary transfer belt 63 from being transferred toward the secondary transfer roller 65. The cleaning bias is a bias (having reverse polarity) that is opposite to the secondary transfer bias. The processor 31 may be configured to apply the cleaning bias to the secondary transfer roller 65 at a timing when the toner image on the outer peripheral surface of the primary transfer belt 63 passes through the transfer nip in which the secondary transfer roller 65 and the primary transfer belt 63 are in close contact with each other. Further, the processor 31 may control the bias control circuit 66 to alternately apply the cleaning bias and the secondary transfer bias to the secondary transfer roller 65 at regular intervals. Accordingly, the toner on the primary transfer belt 63 is not attached to the secondary transfer roller 65, and passes through the transfer nip.

Next, the processor 31 determines whether or not the forward rotation operation is performed by a predetermined distance (Act 34). When it is determined that the forward rotation operation has not been performed by the predetermined distance (Act 34, No), the processor 31 continues the forward rotation operation. Further, when it is determined that the forward rotation operation is performed by the predetermined distance (Act 34, Yes), the processor 31 releases the application of the cleaning bias to the secondary transfer roller 65 (Act 35), and stops the forward rotation operation. In Act 34, the predetermined distance is longer than a distance between the primary transfer position at which the photoconductive drum 71 of the process unit 61 furthest from the transfer nip and the primary transfer belt 63 are in contact with each other and the belt cleaning position at which the outer peripheral surface of the primary transfer belt 63 and the blade of the belt cleaner 67 are in contact with each other. That is, in the process unit 61 that is furthest from the transfer nip, the processor 31 performs the forward rotation operation such that the primary transfer position reaches the belt cleaning position.

Further, as described above, when the cleaning bias is applied to the secondary transfer roller 65, paper dust accumulated near the secondary transfer roller 65 is swept out toward the primary transfer belt 63 by the cleaning bias of the secondary transfer roller 65. Thus, the toner and the paper dust mixedly exists on the outer peripheral surface of the primary transfer belt 63. The paper dust swept out to the primary transfer belt 63 is removed by the belt cleaner 67. However, the paper dust has various sizes, and there is a possibility that the paper dust is caught by the belt cleaner depending on the sizes of the paper dust.

Thus, after causing the photoconductive drum 71, the secondary transfer roller 65, and the secondary transfer counter roller 69 to perform the forward rotation operation by the predetermined distance, the processor 31 causes the photoconductive drum 71, the secondary transfer roller 65, and the secondary transfer counter roller 69 to perform a reverse rotation operation, based on a predetermined value (set reverse rotation amount) (Act 36). That is, the processor 31 rotates the photoconductive drum 71, the secondary transfer roller 65, and the secondary transfer counter roller 69 in a direction that is opposite to that of the forward rotation operation. Accordingly, in the belt cleaning position, the paper dust caught between the outer peripheral surface of the primary transfer belt 63 and the blade of the belt cleaner 67 can be moved upstream of the belt cleaning position.

Further, the set reverse rotation amount is set based on a specification of the belt cleaner 67, paper quality of the printing medium P, and a material of the primary transfer belt 63. When the paper dust is caught between the blade of the belt cleaner 67 and the primary transfer belt 63, the set reverse rotation amount is set to a value at which the paper dust can be removed sufficiently. In detail, the set reverse rotation amount is a value which is set using a not illustrated operation interface by a customer engineer of the image forming apparatus 1.

Further, after causing the photoconductive drum 71, the secondary transfer roller 65, and the secondary transfer counter roller 69 to perform the reverse rotation operation, the processor 31 causes the photoconductive drum 71, the secondary transfer roller 65, and the secondary transfer counter roller 69 to perform the forward rotation operation again (Act 37). Accordingly, the paper dust moved upstream of the belt cleaning position can be removed by the blade of the belt cleaner 67.

The processor 31 determines whether or not the reverse rotation amount at which the photoconductive drum 71, the secondary transfer roller 65, and the secondary transfer counter roller 69 perform the reverse rotation operation in Act 36 is greater than or equal to a predetermined threshold (Act 38). That is, the processor 31 determines whether or not the set reverse rotation amount is greater than or equal to the predetermined threshold.

When it is not less than the predetermined threshold (Act 38, No), the processor 31 performs a toner removing forward rotation operation, which will be described below (Act 39) before resuming the printing operation based on the printing job. When the toner removing forward rotation operation is performed, the processor 31 terminates the cleaning operation of FIG. 4. When the cleaning operation is terminated, the processor 31 proceeds to Act 12 of FIG. 3, and attempts the printing operation based on the printing job again.

Further, when it is determined that the reverse rotation amount is less than the predetermined threshold (Act 38, Yes), the processor 31 terminates the cleaning operation of FIG. 4. When the cleaning operation is terminated, the processor 31 proceeds to Act 12 of FIG. 3, and attempts the printing operation based on the printing job again.

Next, the above-described toner removing forward rotation operation will be described.

The toner removing forward rotation operation is an operation performed when the reverse rotation amount of the photoconductive drum 71, the secondary transfer roller 65, and the secondary transfer counter roller 69 is greater than or equal to the predetermined threshold. The toner removing forward rotation operation is an operation of causing the photoconductive drum 71, the secondary transfer roller 65, and the secondary transfer counter roller 69 to perform the forward rotation operation based on the predetermined threshold (set forward rotation amount).

The above-described threshold is determined based on a distance between the photoconductor cleaning position where the blade of the photoconductor cleaner 72 and the photoconductive drum 71 are in contact with each other and the primary transfer position where the primary transfer belt 63 and the photoconductive drum 71 are in contact with each other, on the surface of the photoconductive drum 71. For example, the above-described threshold is set to a value that is equal to a distance between the photoconductor cleaning position and the primary transfer position, on the surface of the photoconductive drum 71.

When the photoconductive drum 71 performs the reverse rotation operation, the toner attached to the blade of the photoconductor cleaner 72 is transferred to the surface of the photoconductive drum 71 in the photoconductor cleaning position. Thus, the photoconductive drum 71 performs the reverse rotation operation while the toner is attached to the surface of the photoconductive drum 71.

As described above, when the reverse rotation amount of the photoconductive drum 71 is greater than or equal to the threshold, the toner attached to the surface of the photoconductive drum 71 from the photoconductor cleaner 72 passes through the primary transfer position. Thus, the toner is attached to the primary transfer belt 63 from the photoconductive drum 71. Therefore, the printing operation cannot be restarted immediately.

Thus, as described above, when the reverse rotation amount of the photoconductive drum 71 is greater than or equal to the threshold, the processor 31 performs a toner removing forward rotation operation. A set forward rotation amount of the toner removing forward rotation operation is set based on the positions of the primary transfer belt 63, the secondary transfer roller 65, and the belt cleaner 67, and the position of the photoconductive drum 71 of each process unit 61.

When the toner is attached to the primary transfer belt 63 from the photoconductive drum 71, if the forward rotation operation continues, the toner attached to the primary transfer belt 63 is transported by the primary transfer belt 63 and is removed by the belt cleaner 67. Further, a part of the toner attached to the primary transfer belt 63 is attached to the secondary transfer roller 65 in the transfer nip. The toner attached to the secondary transfer roller 65 is attached to the primary transfer belt 63 in the transfer nip again, is transported by the primary transfer belt 63, and is removed by the belt cleaner 67. Thus, the set forward rotation amount needs to be set to a value at which the toner attached to the secondary transfer roller 65 can be sufficiently attached to the primary transfer belt 63 and can be removed by the belt cleaner 67. In detail, the set forward rotation amount is a value set by operating the not illustrated operation interface by the customer engineer of the image forming apparatus 1.

As described above, the image forming apparatus 1 includes the photoconductive drum 71 on which the toner image is formed, the primary transfer belt 63 which is in contact with the photoconductive drum 71 and receives the toner image from the photoconductive drum 71, the secondary transfer counter roller 69 which moves the primary transfer belt 63, the secondary transfer roller 65 which presses the printing medium P against the primary transfer belt 63 and transfers the toner image on the primary transfer belt 63 to the printing medium P, the bias control circuit 66 which applies the bias to the secondary transfer roller 65, a belt cleaner 67 which is in contact with the primary transfer belt 63 and removes the attached matters such as the toner and paper dust from the primary transfer belt 63, and the system controller 14. The processor 31 of the system controller 14 causes the photoconductive drum 71, the secondary transfer counter roller 69, and the secondary transfer roller 65 to perform the forward rotation operation and applies the secondary transfer bias to the secondary transfer roller 65 by the bias control circuit 66. Accordingly, the processor 31 performs the printing operation of transferring the toner image transferred to the primary transfer belt 63 from the photoconductive drum 71, to the printing medium P passing through the transfer nip in which the primary transfer belt 63 and the secondary transfer roller 65 are in close contact with each other.

Further, when the printing operation is interrupted after the printing operation is performed, the processor 31 applies, to the secondary transfer roller 65, a bias (cleaning bias) having a polarity that is opposite to that of the secondary transfer bias during the printing operation by the bias control circuit 66 and causes the photoconductive drum 71, the secondary transfer counter roller 69, and the secondary transfer roller 65 to perform the forward rotation operation. Accordingly, the processor 31 removes the attached matters attached to the primary transfer belt 63 by the belt cleaner 67.

Further, the processor 31 causes the photoconductive drum 71, the secondary transfer counter roller 69, and the secondary transfer roller 65 to perform the reverse rotation operation. Accordingly, in the belt cleaning position where the belt cleaner 67 and the primary transfer belt 63 are in contact with each other, the paper dust caught between the outer peripheral surface of the primary transfer belt 63 and the blade of the belt cleaner 67 can be moved to an upstream side of the belt cleaning position.

Further, the processor 31 causes the photoconductive drum 71, the secondary transfer roller 65, and the secondary transfer counter roller 69 to restart the forward rotation operation. Accordingly, the paper dust moved to the upstream side of the belt cleaning position can be removed by the blade of the belt cleaner 67. As a result, as an alternating bias including a reverse bias is applied to the secondary transfer roller 65, even when the paper dust is swept out to the primary transfer belt side, it is possible to prevent the paper dust from being caught by the belt cleaner 67.

Further, when the printing operation is interrupted, the processor 31 performs a control to perform the forward rotation operation by a length until the toner attached to the primary transfer belt 63 from the photoconductive drum 71 is removed by the belt cleaner 67, to perform the above-described reverse rotation operation in a direction that is opposite to that of the forward rotation operation, to restart the forward rotation operation, and to restart the printing operation. Accordingly, the toner attached to the primary transfer belt 63 from the photoconductive drum 71 can be removed by the belt cleaner 67.

Further, the image forming apparatus 1 further includes a photoconductor cleaner 72 that removes the toner attached to the photoconductive drum 71. When the reverse rotation amount of the photoconductive drum 71 is greater than or equal to the predetermined threshold, the processor 31 continues the forward rotation operation after restarting the forward rotation operation, causes the photoconductive drum 71 and the secondary transfer roller 65 to perform the toner removing forward rotation operation of removing the toner attached to the photoconductive drum 71 from the photoconductor cleaner 72 by the belt cleaner 67.

That is, when the reverse rotation amount (set reverse rotation amount) of the reverse rotation operation is less than the predetermined threshold, the processor 31 performs the forward rotation operation by a first length (reverse rotation amount) after the reverse rotation operation, and controls the image forming unit 20 to restart the printing operation. Further, when the reverse rotation amount of the reverse rotation operation is greater than or equal to the predetermined threshold, the processor 31 performs the forward rotation operation by a second length (reverse rotation amount) that is longer than the first length (reverse rotation amount) after the reverse rotation operation, and controls the image forming unit 20 to restart the printing operation. The second length is a length until the toner attached to the photoconductive drum 71 from the photoconductor cleaner 72 is removed by the belt cleaner 67 during the reverse rotation operation. In more detail, the second length is a length by which the secondary transfer roller 65 rotates by N rotations (for example, one rotation) or more during the reverse rotation operation after the position of the primary transfer belt 63 when the photoconductor cleaning position passes through the primary transfer position reaches the transfer nip in which the secondary transfer roller 65 and the primary transfer belt 63 are in close contact with each other. Accordingly, the toner attached to the photoconductive drum 71 from the photoconductor cleaner 72 and attached to the primary transfer belt 63 from the photoconductive drum 71 can be removed by the belt cleaner 67.

Further, the threshold used for comparison with the reverse rotation amount of the photoconductive drum 71 is determined based on the distance between the photoconductor cleaning position where the photoconductor cleaner 72 and the photoconductive drum 71 are in contact with each other and the primary transfer position where the primary transfer belt 63 and the photoconductive drum are in contact with each other, on the surface of the photoconductive drum 71. Accordingly, the processor 31 can determines whether or not the toner removing forward rotation operation is performed, based on whether or not the toner attached to the photoconductive drum 71 from the photoconductor cleaner 72 passes through the primary transfer position.

That is, when the photoconductor cleaning position does not straddle the primary transfer position due to the reverse rotation operation, the processor 31 restarts the forward rotation operation and restarts the printing operation. Further, when the photoconductor cleaning position straddles the primary transfer position due to the reverse rotation operation, the processor 31 performs the forward rotation operation based on the predetermined set forward rotation amount and restarts the printing operation. At least when the photoconductor cleaning position does not straddle the primary transfer position by the reverse rotation operation, the set forward rotation amount is a distance that is longer than a distance of the forward rotation operation between a time when the forward rotation operation is restarted and a time when the printing operation is restarted. That is, when the photoconductor cleaning position straddles the primary transfer position, the processor 31 performs a control such that the distance of the forward rotation operation until the printing operation is restarted becomes longer than that of a case where the photoconductor cleaning position does not straddle the primary transfer position. In more detail, the set forward rotation amount is set such that the toner attached to the photoconductive drum 71 from the photoconductor cleaner 72 by the reverse rotation operation is removed by the belt cleaner 67. Accordingly, the toner attached to the photoconductive drum 71 from the photoconductor cleaner 72 and attached to the primary transfer belt 63 from the photoconductive drum 71 can be removed by the belt cleaner 67 and the printing operation can be restarted.

Further, although it is described in the above embodiment that the set forward rotation amount is set such that the toner attached to the secondary transfer roller 65 from the primary transfer belt 63 by the reverse rotation operation is attached to the primary transfer belt 63 again, an exemplary embodiment is not limited to this configuration. The image forming unit 20 may be configured to further include a cleaner attached to the secondary transfer roller 65. With this configuration, since it is unnecessary to move the toner from the secondary transfer roller 65 to the primary transfer belt 63, the set forward rotation amount can be reduced.

Further, although it is described in the above embodiment that the fixing device 68 is configured to include the heat roller 91 and the heater 92 as a heating member, the exemplary embodiment is not limited to this configuration. The fixing device 68 may be configured to include a film-shaped member for improving slipping of the printing medium P and a thermal head for applying heat to the printing medium P through the film-shaped member as a heating member instead of the heat roller 91 and the heater 92.

The film-shaped member is a fixing rotation body. The film-shaped member includes a core member formed of heat-resistant resin and a release layer formed outside the core member.

The thermal head includes, for example, a substrate formed of ceramic, a heating resistor layer (heat generating member: TaSiO2) formed on the substrate, a positive electrode, and a negative electrode. The thermal head has a plurality of combinations of the heating resistor layer, the positive electrode, and the negative electrode. The plurality of combinations of the heating resistor layer, the positive electrode, and the negative electrode are arranged in a main scanning direction (direction that is parallel to shaft of press roller 93) in a state in which adjacent heating members are insulated from each other. In the thermal head, when a current flows from the positive electrode via the heating resistor layer to the negative electrode, the heating resistor layer is heated.

When the fixing device 68 is configured in this manner, the press roller 93 applies pressure to the thermal head through the film-shaped member. Accordingly, the fixing nip is formed in which the press roller 93 and the film-shaped member are in close contact with each other. Further, the press roller 93 rotates while pressing the printing medium P against the film-shaped member. Accordingly, the printing medium P passes through the fixing nip. The system controller 14 or a not illustrated controller of the fixing device 68 heats the heat generating member of the thermal head at a timing when the printing medium P passes through the fixing nip. Accordingly, the heat and the pressure is applied to the printing medium P passing through the fixing nip. As a result, the toner image is fixed to the printing medium P.

Further, although it is described in the above embodiment that when the paper feeding retrying operation occurs, when the automatic cassette changing operation occurs, or when the tandem LCF transfer operation occurs, the processor 31 determines to interrupt the printing operation, the exemplary embodiment is not limited thereto. The processor 31 may be configured to determine to interrupt the printing operation when a manual irregular printing operation is performed.

The manual irregular printing operation is a printing operation using the printing medium P disposed in the manual feeding tray 18. When the manual feeding tray 18 is selected as a paper feeding tray used for printing, the processor 3*l* controls the transport unit 19 to introduce the printing medium P disposed in the manual feeding tray 18 into the paper feeding transport path 51. Here, description will be made based on an assumption that the plurality of printing mediums P arranged in the manual feeding tray 18 are printed.

The processor 31 controls the image forming unit 20 to form an image on the printing medium P introduced from the manual feeding tray 18. The processor 31 forms the image on a first printing medium P introduced from the manual feeding tray 18, applies the cleaning bias to the secondary transfer roller in the same manner as in Act 33 of FIG. 4, and continues the forward rotation operation. Accordingly, the attached matters attached to the secondary transfer roller 65 is transferred to the primary transfer belt 63 and is removed by the belt cleaner 67. Further, like Act 35 to Act 37 of FIG. 4, the processor 31 releases the cleaning bias, performs the reverse rotation operation, and restarts the forward rotation operation. Further, like Act 38 and Act 39, when a reverse rotation distance is greater than or equal to a threshold, the processor 31 controls the image forming unit 20 to perform the printing operation on second and subsequent printing mediums P after performing the toner removing forward rotation operation. Further, when the reverse rotation distance is less than the threshold, the processor 31 controls the image forming unit 20 to perform the printing operation on the second and subsequent printing mediums P without performing the toner removing forward rotation operation. Even with this configuration, the toner attached to the photoconductive drum 71 from the photoconductor cleaner 72 and attached to the primary transfer belt 63 from the photoconductive drum 71 can be removed by the belt cleaner 67.

Further, the functions described in the above embodiments are not only limited to a hardware configuration but also can be realized by loading programs having the functions using software to a computer. Further, the functions may be configured by selecting any one of proper software and proper hardware.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming device comprising:

a photoconductive drum that forms a toner image;

a primary transfer belt that comes in contact with the photoconductive drum and receives the toner image from the photoconductive drum;

a secondary transfer counter roller that moves the primary transfer belt;

a secondary transfer roller that presses a printing medium against the primary transfer belt to transfer the toner image on the primary transfer belt to the printing medium;

a bias control circuit operable to apply a bias to the secondary transfer roller;

a belt cleaner in contact with the primary transfer belt and removes attached matters from the primary transfer belt; and a processor configured to:

interrupt a printing operation of transferring the toner image to the printing medium after an initiation of the printing operation based on an interrupting event command, during the interruption of the printing operation, the photoconductive drum, the secondary transfer counter roller, and the secondary transfer roller to perform a forward rotation operation while applying a bias having a polarity opposite to that in the printing operation to the secondary transfer roller by the bias control circuit, control a reverse rotation operation to be performed in a direction opposite to the forward rotation operation, restart the forward rotation operation, and restart and resume the printing operation interrupted by the interrupting event.

2. The image forming device according to claim 1, wherein the processor performs, when a reverse rotation amount of the reverse rotation operation is less than a predetermined threshold, the forward rotation operation by a first length after the reverse rotation operation, and performs, when the reverse rotation amount of the reverse rotation operation is greater than or equal to the predetermined threshold, the forward rotation operation by a second length that is longer than the first length after the reverse rotation operation.

3. The image forming device according to claim 2, further comprising: a photoconductor cleaner that removes toner attached to the photoconductive drum, wherein the predetermined threshold is set based on a distance between a photoconductor cleaning position where the photoconductor cleaner and the photoconductive drum are in contact with each other and a primary transfer position where the primary transfer belt and the photoconductive drum are in contact with each other.

4. The image forming device according to claim 3, wherein the second length is a length until the toner, attached to the photoconductive drum from the photoconductor cleaner during the reverse rotation operation, is removed by the belt cleaner.

5. The image forming device according to claim 4, wherein the second length is a length by which the secondary transfer roller rotates by one rotation or more after a position of the primary transfer belt, when the photoconductor cleaning position passes through the primary transfer position in the reverse rotation operation, reaches a transfer nip in which the secondary transfer roller and the primary transfer belt are in close contact with each other.

6. The image forming device according to claim 1, wherein during the interruption of the printing operation, the processor controls the primary transfer belt via at least the primary transfer roller to perform the forward rotation operation by a length until toner attached to the primary transfer belt from the photoconductive drum is removed by the belt cleaner, perform the reverse rotation operation in the direction that is opposite to the forward rotation operation, restart the forward rotation operation, and restart the printing operation.

7. A method of controlling an image forming apparatus including a photoconductive drum that forms a toner image, a primary transfer belt that comes in contact with the photoconductive drum and receives the toner image from the photoconductive drum, a secondary transfer counter roller that moves the primary transfer belt, a secondary transfer roller that presses a printing medium against the primary transfer belt to transfer the toner image on the primary transfer belt to the printing medium, a bias control circuit that applies a bias to the secondary transfer roller, a belt cleaner that is in contact with the primary transfer belt and removes attached matters from the primary transfer belt, and a processor, the method comprising:

controlling, via the processor, during an interruption of a printing operation of transferring the toner image to the printing medium after initiating the printing operation, the image forming apparatus to:

perform a forward rotation operation by the photoconductive drum, the secondary transfer counter roller, and the secondary transfer roller while applying a bias having a polarity that is opposite to that in the printing operation to the secondary transfer roller by the bias control circuit, perform a reverse rotation operation in a direction that is opposite to the forward rotation operation, restart the forward rotation operation, and resume or restart the printing operation.

8. The method of claim 7, further comprises:

performing, via the processor and when a reverse rotation amount of the reverse rotation operation is less than a predetermined threshold, the forward rotation operation by a first length after the reverse rotation operation; and performing, when the reverse rotation amount of the reverse rotation operation is greater than or equal to the predetermined threshold, the forward rotation operation by a second length that is longer than the first length after the reverse rotation operation.

9. The method of claim 8, further comprising removing toner attached to the photoconductive drum using a photoconductor cleaner, wherein the predetermined threshold is set based on a distance between a photoconductor cleaning position where the photoconductor cleaner and the photoconductive drum are in contact with each other and a primary transfer position where the primary transfer belt and the photoconductive drum are in contact with each other.

10. The method of claim 9, wherein the second length is a length until the toner, attached to the photoconductive drum from the photoconductor cleaner during the reverse rotation operation, is removed by the belt cleaner.

11. The method of claim 10, wherein the second length is a length by which the secondary transfer roller rotates by one rotation or more after a position of the primary transfer belt, when the photoconductor cleaning position passes through the primary transfer position in the reverse rotation operation, reaches a transfer nip in which the secondary transfer roller and the primary transfer belt are in close contact with each other.

12. A method for cleaning a primary transfer belt used in an image forming device, the method comprising:

performing a forward rotation operation of a primary transfer belt actuated by at least a primary transfer roller;

applying a cleaning bias to a secondary transfer roller;

determining whether the forward rotation operation has reached a predetermined distance;

releasing, upon a determination that the forward rotation operation has reached the predetermined distance, the cleaning bias of the secondary transfer roller;

performing a reverse rotation operation;

performing a second forward rotation operation;

determining whether the reverse rotation operation has reached a rotation amount less than a threshold; and removing toner, upon determining that the reverse rotation operation has reached a rotation amount greater than or equal to the threshold, in a toner removing forward rotation operation.

13. The method of claim 12, further comprising turning off an electrifying charger before applying the cleaning bias to the secondary transfer roller.

14. The method of claim 12, further comprising:

starting a forward rotation operation for a printing operation;

turning on an electrifying charger;

forming a latent image on a photoconductive drum;

forming a toner image on the photoconductive drum;

applying a secondary transfer bias to the primary transfer roller;

applying a secondary transfer bias to the secondary transfer roller; and determining whether the printing operation is interrupted.

15. The method of claim 14, wherein removing toner in a toner removing forward rotation operation is performed upon a determination that the printing operation is interrupted.

16. The method of claim 15, wherein the printing operation is interrupted when a toner image on the primary transfer belt cannot be transferred to a printing medium.

17. The method of claim 15, wherein the printing operation is interrupted when a toner image cannot be transfer to a printing medium in a transfer nip formed between the primary transfer belt and the secondary transfer roller after an electrostatic latent image is formed on a photoconductive drum in contact with the primary transfer belt and against the primary transfer roller.

18. The method of claim 15, wherein the printing operation is interrupted when a supply of a printing medium is interrupted.

* * * * *